United States Patent [19]

Kawamura et al.

[11] Patent Number: 4,906,546

[45] Date of Patent: Mar. 6, 1990

[54] ELECTROPHOTOGRAPHIC SENSITIVE MEMBER

[75] Inventors: Takao Kawamura, 17-11, 1-cho, Takakuradai, Sakai-shi, Osaka-fu; Naooki Miyamoto, Yohkaichi; Hiroshi Ito, Yohkaichi; Hitoshi Takemura, Yohkaichi; Kazumasa Ohkawa, Yohkaichi; Kokichi Ishibitsu, Yohkaichi, all of Japan

[73] Assignees: Kyocera Corporation, Kyoto; Takao Kawamura, Osaka, both of Japan

[21] Appl. No.: 244,750

[22] Filed: Sep. 15, 1988

[30] Foreign Application Priority Data

May 14, 1988 [JP] Japan ..... 63-117657
May 14, 1988 [JP] Japan ..... 63-117658

[51] Int. Cl.[4] ..... G03G 5/14
[52] U.S. Cl. ..... 430/59; 430/58
[58] Field of Search ..... 430/58, 59

[56] References Cited

U.S. PATENT DOCUMENTS 4,510,224 4/1985 Yamazaki et al. ..... 430/57

FOREIGN PATENT DOCUMENTS 3418596 11/1984 Fed. Rep. of Germany ..... 430/58
61-281249 12/1986 Japan ..... 430/58
63-85566 4/1988 Japan ..... 430/58

*Primary Examiner*—Roland E. Martin
*Attorney, Agent, or Firm*—Spensley, Horn, Jubas & Lubitz

[57] ABSTRACT

The present invention relates to an electrophotographic sensitive member, in particular to a divided function type electrophotographic sensitive member formed of amorphous silicon and amorphous silicon carbide capable of particularly widening an optical band gap range to heighten an optical sensitivity.

Stabilized operation characteristics and durability are required for an electrophotographic sensitive member drum carried on instruments such as a high-speed copying machine and a laser beam printer. As for these requirements, hydrogenized amorphous silicon is being watched with interest from the viewpoints of superior abrasion resistance, heat resistance, anti-pollution property, optical sensitive characteristic and the like.

However, even multi-layer type sensitive member and a divided function type sensitive member, which have been known as an electrophotographic sensitive member formed of hydrogenized amorphous silicon, have shown problems in that in the case where they are used in the high-speed copying, a residual image, in which the preceding image remains without being completely removed by an optical memory effect and appears again with the formation of the subsequent image, occurs, and an image exposure per one time of copying is reduced by the high-speediness, whereby the sufficient optical attenuation can not be obtained and the potentiality of the sensitive member corresponding to a shading contrast of a manuscript can not be sufficiently increased, so that a background smearing is produced.

The present invention aims at the obtainment of an electrophotographic sensitive member capable of solving such problems and provides an electrophotographic sensitive member capable of heightening an optical sensitivity over a wide wavelength range to obtain sufficient optical attenuation characteristics, whereby being suitable for the high-speed copying.

14 Claims, 9 Drawing Sheets

ELECTROPHOTOGRAPHIC SENSITIVE MEMBER

BACKGROUND OF THE INVENTION

The present invention relates to a divided function type electrophotographic sensitive member formed of amorphous silicon and amorphous silicon carbide, in particular to an electrophotographic sensitive member capable of widening particularly an optical band gap range to heighten an optical sensitivity.

Recently, the development of a super high speed copying machine, a laser beam printer and the like has actively progressed. Stabilized operation characteristics and durability have been required for an electrophotographic sensitive drum carried on such instruments with this development. As for these requirements, hydrogenized amorphous silicon is being watched with interest from the viewpoints of superior abrasion resistance, heat resistance, antipollution property, optical sensitive characteristics and the like.

A multi-layer type sensitive member shown in FIG. 3 has been proposed for an electrophotographic sensitive member formed of such amorphous silicon (hereinafter referred to as a-Si).

That is to say, referring to FIG. 3, an a-Si carrier barrier layer (2*a*), an a-Si carrier-generating layer (3*a*) and a surface-protecting layer (4*a*) are piled up in turn on an electrically conductive substrate (1*a*) such as aluminum, said carrier barrier layer (2*a*) being formed for preventing carriers from being injected from said substrate (1*a*) and lowering a residual potential, and said surface-protecting layer (4*a*) being formed of materials of high hardness to heighten the durability of the sensitive member.

However, with this a-Si sensitive member, a dark resistance of the a-Si carrier-generating layer (3*a*) itself is $10^{11}\Omega\cdot$cm or less, so that a darkness-attenuation speed of this sensitive member is increased and it is difficult to heighten a charge-acceptance of this sensitive member itself, whereby problems occur in that in the event that this sensitive member is used in the high-speed copying, the preceding image remains without being completely removed by an optical memory effect and appears again with the formation of the subsequent image (this is referred to as a residual image in the present invention).

In order to solve these problems, a divided function type sensitive member shown in FIG. 4 has been proposed.

That is to say, referring to FIG. 4, a carrier transport layer (5*a*) and a carrier-generating layer (3*b*), and a surface protective layer (4*a*) if necessary, are formed in turn on an electrically conductive substrate (1*a*) to obtain a multi-layer type sensitive member. Said carrier transport layer (5*a*) is formed of materials capable of increasing both the dark resistance and the carrier mobility. And, with a divided function type sensitive member, in which the above described respective layers are formed of a-Si or amorphous silicon carbide (hereinafter referred to as a-SiC) obtained by doping a-Si with carbon atoms (C), even though it was used in the high-speed copying, said residual image could be prevented from occurring.

However, in the case where the above described sensitive member is used in the high-speed copying in the above described manner, the problems occur in that the image exposure perone time of copying is reduced by the high-speediness, so that the sufficient optical attenuation is not obtained and the potentiality of the sensitive member corresponding to the shading contrast of the manuscript is not sufficiently increased, whereby the background smearing is produced.

SUMMARY OF THE INVENTION

Thus, it is an object of the present invention to provide an electrophotographic sensitive member capable of heightening an optical sensitivity over a wide wavelength range to obtain sufficient optical attenuation characteristics, whereby being suitable for the high-speed copying.

According to the present invention, an electrophotographic sensitive member, in which at least a carrier transport layer and a carrier-generating layer are formed on an electrically conductive substrate, characterized by that said carrier-generating layer is formed of a layer zone formed of a-Si and a layer zone formed of a-SiC containing elements of the group III*a* or V*a* in the Periodic Table in a quantity of 0.5 to 100 ppm formed in turn.

DETAILED DESCRIPTION

Figure 2:
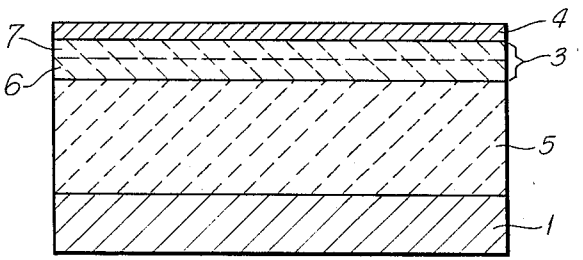
FIGS. 1, 2 are sectional views showing a layer structure of an electrophotographic sensitive member according to the present invention.
Figure 4:
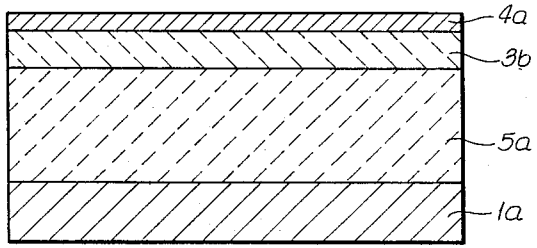
FIGS. 3, 4 are sectional views showing a layer structure adopted in the conventional electrophotographic sensitive member.
Figure 1:
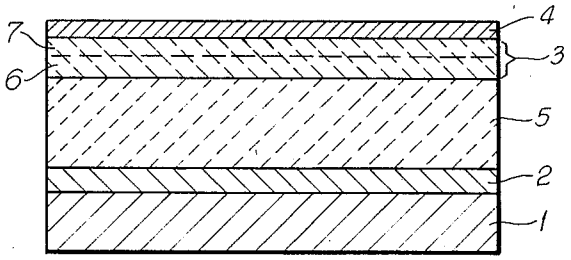
Figure 3:
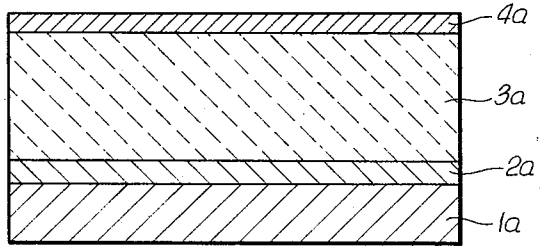
Figure 6:
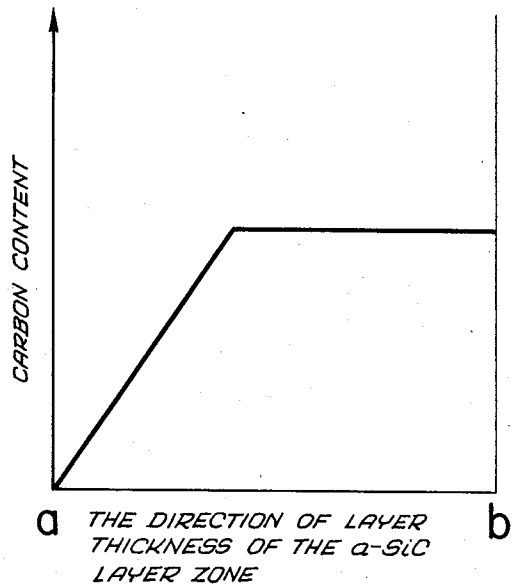
FIGS. 5 to 10 are graphs showing carbon doping distributions.
Figure 5:
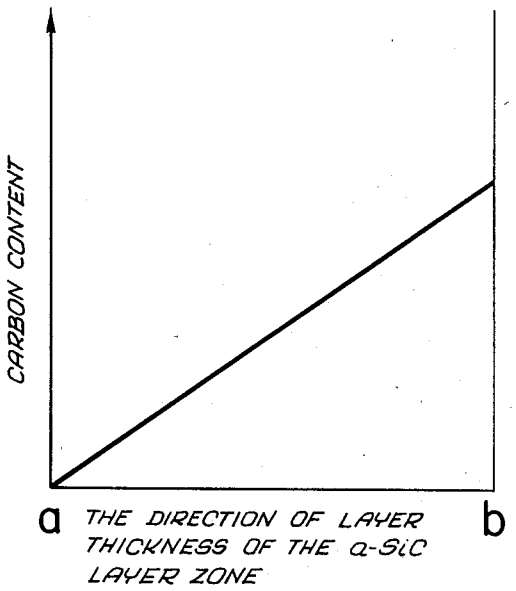
Figure 8:
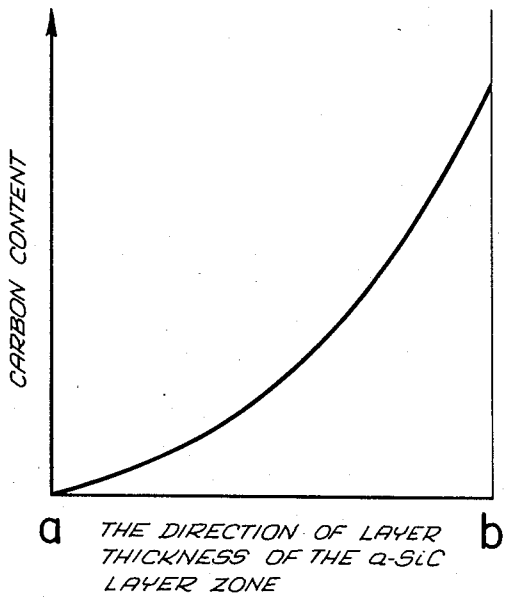
Figure 7:
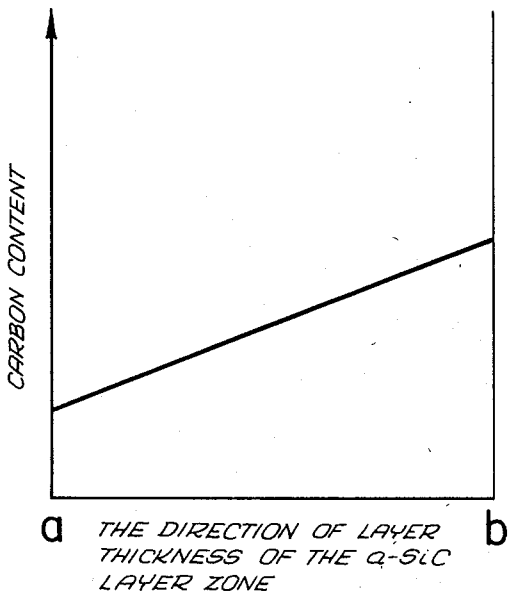
Figure 10:
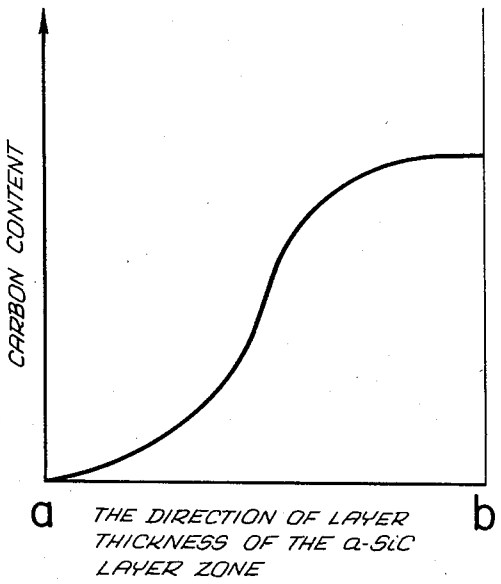
Figure 9:
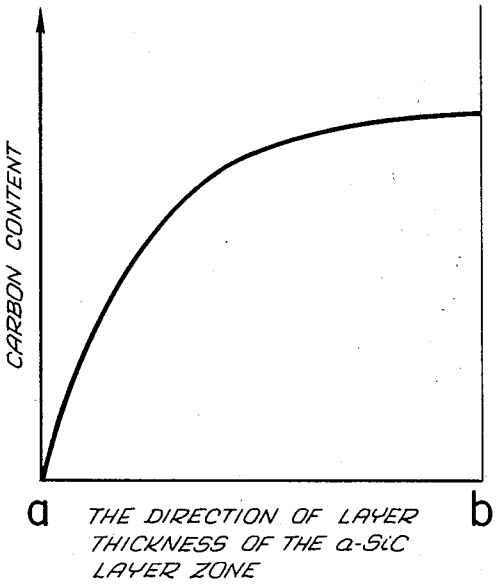
Figure 12:
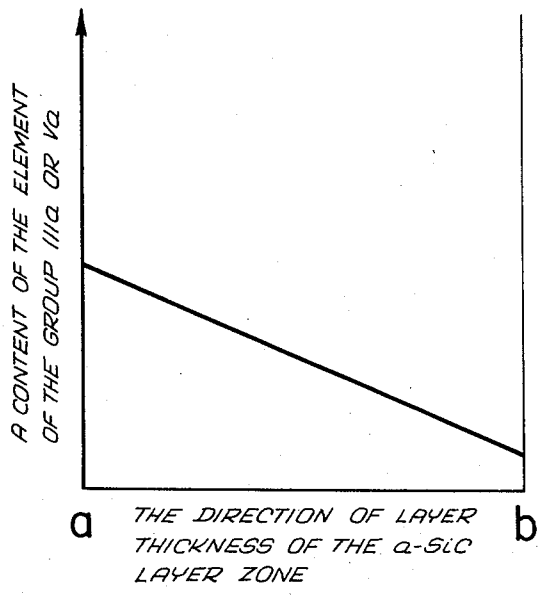
FIGS. 11 to 16 are graphs showing doping distributions of elements of the group III*a* or V*a* in the periodic table.
Figure 11:
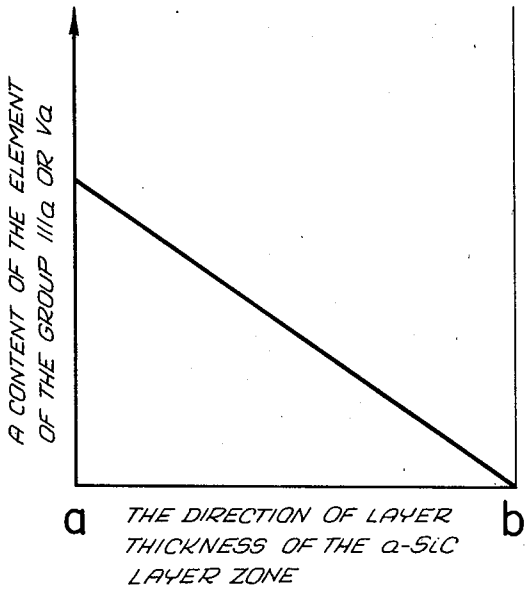
Figure 14:
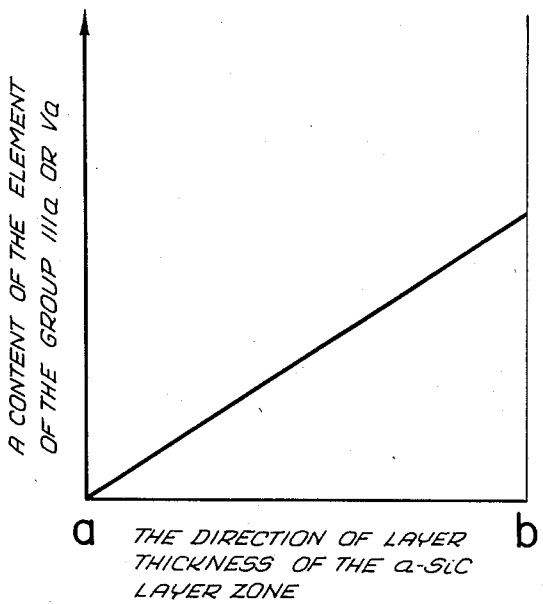
Figure 13:
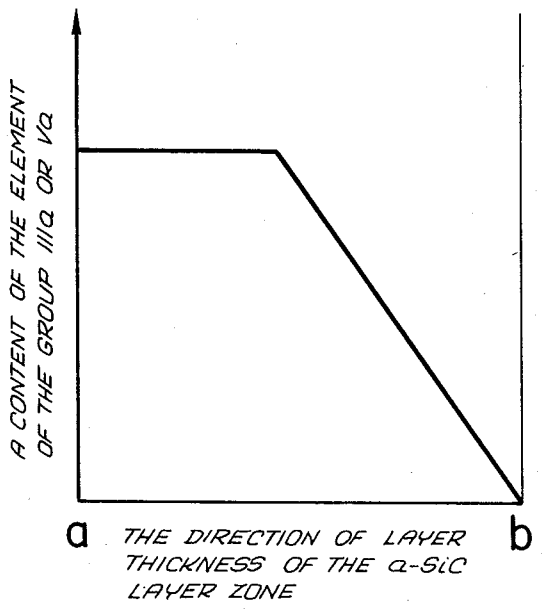
Figure 16:
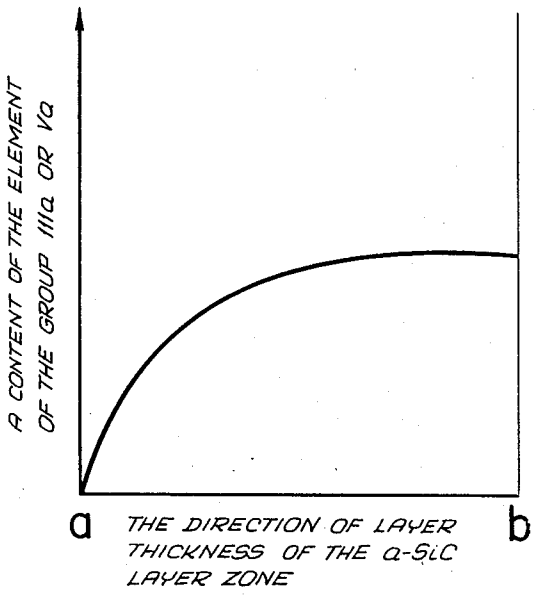
Figure 15:
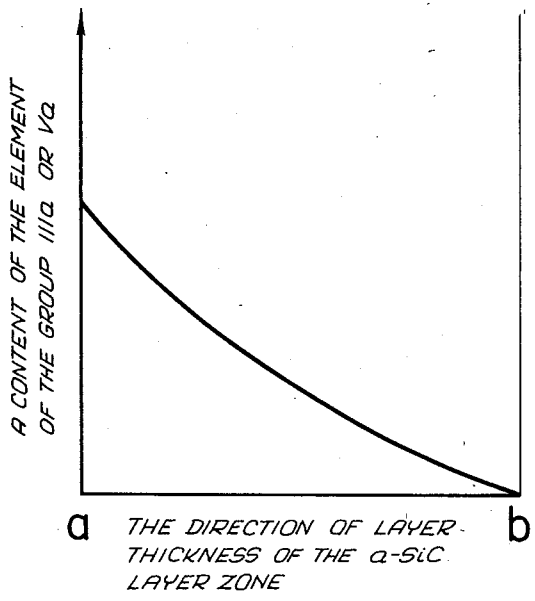

FIGS. 1, 2 show a typical layer structure of an electrophotographic sensitive member according to the present invention. Referring now to FIG. 1, a multi-layer type sensitive member, in which a carrier barrier layer (2), a carrier transport layer (5), a carrier-generating layer (3) and a surface protective layer (4) are piled up in turn on an electrically conductive substrate (1), or the carrier barrier layer (2) shown in FIG. 1 is omitted, as shown in FIG. 2, is shown.

The present invention is characterized by that said carrier-generating layer (3) is formed of at least two kinds of layer zone to increase the optical sensitivity over the wide wavelength range.

This carrier-generating layer (3) comprises an amorphous silicon layer zone (hereinafter referred to as a-Si layer zone) (6) and an amorphous silicon carbide layer zone (hereinafter referred to as a-SiC layer zone) (7) formed in turn in a direction of layer thickness toward a surface of the sensitive member from a side of the substrate, said a-SiC layer zone (7) containing the elements of the group III*a* or V*a* in the periodic table (hereinafter referred to as elements of the group III*a* or V*a*) in a quantity within an appointed range.

The present inventors have found it from their experiments that the a-SiC layer zone (7) containing the appointed quantity of elements of the group III*a* or V*a* remarkably heightens the optical sensitivity on a side of shorter wavelengths and achieved the present invention on the basis of this knowledge.

Of a light incident upon the sensitive member from its surface side, a light within a shorter wavelength side is absorbed by the a-SiC layer zone (7) and a light, which passed through the layer zone (7), that is, a light within a longer wavelength range, is absorbed by the a-Si layer zone (6), whereby the optical sensitivity can be heightened in both the shorter wavelength side and the longer wavelength side.

At first, as to the a-SiC layer zone (7), the photoconductance is brought about by using amorphous Si element and C element as indispensable constituent elements and containing a hydrogen (H) element and halogen elements in a quantity within an appointed range so as to terminate dangling bond. It has been found from the present inventors' experiments for confirming the photoconductance with variously changing a content of the C element that in the case where an atomic ratio of the C element to the Si element, that is, a value of x of $Si_{(1-x)}$ $C_x$ is set so that $0.01 \leqq x \leqq 0.5$, preferably $0.05 \leqq x \leqq 0.3$, may hold good, the dark conductance can be reduced and the optical sensitivity in the shorter wavelength side can be heightened.

In addition, it is desired that a content of the element A, such as the hydrogen element and the halogen elements, for terminating the dangling bond is set so that a value of y in $[Si_{(1-x)}\ C_x]_{1-y}[A]_y$ may hold good $0.05 \leqq y \leqq 0.5$, preferably $0.05 \leqq y \leqq 0.4$, and optimally $0.1 \leqq y \leqq 0.3$. In usual, a H element is used as this element A from the viewpoint of the matter that it can be easily taken in the terminating portion of the dangling bond and the density of the localized state in the band gap is reduced.

It is desired that a thickness of this a-SiC layer zone (7) is set within a range of 0.05 to 5 μm, preferably 0.1 to 3μm. There is a tendency that in the case where this thickness is less than 0.05 μm, the light having shorter wavelengths is insufficiently absorbed to make the heightening of the optical sensitivity difficult while in the case where it exceeds 5 μm, a residual potential is increased.

The atomic ratio of the C element to the Si element in the above described a-SiC layer zone (7), that is, said value x may be uniform or changed in the direction of layer thickness.

In the case where the value of x is changed in the direction of layer thickness, it is desired that the thickness of the layer zone (7) is determined within a range of the value of x of $0.01 \leqq x \leqq 0.5$ and also the thus determined thickness is set within a range of 0.05 to 5 μm, preferably 0.1 to 3 μm.

In the case where the value x is changed in the direction of layer thickness in such the manner, there are six kinds of carbon doping distribution as shown in for example FIGS. 5 to 10.

Referring to the respective drawings, an axis of abscissa shows the direction of layer thickness of the a-SiC layer zone (7), a showing an interface of the a-SiC layer zone (7) and the a-Si layer zone (6), b showing an interface opposite to the above described interface of the a-SiC layer zone (7) and the a-Si layer zone (6), and an axis of ordinate showing a carbon-content.

In addition, it is desired that the elements of the group III*a* or V*a* are uniformly contained in the direction of layer thickness in a quantity within a range of 0.5 to 100 ppm, preferably 1 to 50 ppm. If this content is less than 0.5 ppm, a sufficiently large optical sensitivity can not be obtained while if it exceeds 100 ppm, the charge acceptance is reduced.

The above described elements of the group III*a* include B, Al, Ga, In and the like and the elements of the group V*a* include N, P, As, Sb and the like. Above all, B is preferably used as the elements of the group III*a* and P as the elements of the group V*a* from the viewpoint of the matter that they are superior in covalent bonding capacity to be capable of sensitively changing semiconductor characteristics and further the superior charge acceptance and photosensitivity can be obtained.

And, in the case where the elements of the group III*a* are contained in the above described manner, the positively charged sensitive member is obtained while in the case where the elements of the group V*a* are contained, the negatively charged sensitive member is obtained.

When the elements of the group III*a* or V*a* are contained in the a-SiC layer zone (7) in the above described manner, their doping distribution may be non-uniform in the direction of layer thickness. There are six kinds of doping distribution as shown in for example FIGS. 11 to 16.

Referring to the respective drawings, an axis of abscissa shows the direction of layer thickness of the a-SiC layer zone (7), a showing an interface of the a-SiC layer zone (7) and the a-Si layer zone (6), b showing an interface opposite to the interface of the a-SiC layer zone (7) and the a-Si layer zone (6), and an axis of ordinate showing a content of the elements of the group III*a* or V*a*.

In the case where the content of the elements of the group III*a* or V*a* is changed in the direction of layer thickness in the above described manner, that content is expressed by a mean value all over the a-SiC layer zone (7).

In addition, said a-Si layer zone (6) consists of an amorphous Si element and the H element or the halogen elements for terminating the dangling bond of said amorphous Si element. Of incident rays, a light on the longer wavelength side is absorbed.

It is desired that a thickness of said a-Si layer zone (6) is set within a range of 0.05 to 5 μm, preferably 0.1 to 3 μm. Advantages occur in that if it is within the above described range, a high charge acceptance can be obtained and a light having longer wavelengths can be effectively absorbed.

In addition, although the a-Si layer zone (6) is a layer substantially not containing the carbon element, a remarkably small quantity of carbon element may be contained. In this case, if the carbon element is contained in a quantity within a range of 1,000 ppm or less, preferably 500 ppm or less, the photosensitivity to the light having longer wavelengths is not remarkably reduced.

In addition, the elements of the group III*a* or V*a* may be contained in the a-Si layer zone (6) in a quantity within a range of 0.01 to 10 ppm, preferably 0.1 to 5 ppm. If they are contained in the quantity within said range, advantages occur in that the high charge acceptance can be obtained and further the residual potential can be reduced. In addition, the doping distribution of the elements of the group III*a* or V*a* may be either uniform or non-uniform in the direction of layer thickness. The content in the case of the non-uniform doping is expressed by a mean value all over the layer zone (6).

And, the elements of the group III*a* contained in the a-Si layer zone (6) in the above described manner include B, Al, Ga, In and the like. In addition, the elements of the group V*a* include N, P, As, Sb and the like.

Said carrier transport layer (5) can be formed of every material having a high resistance and a sufficiently large carrier-mobility. This material includes organic semi-conductors, such as PVK, pyrazoline, oxazol, hydrazone, N-phenylcarbazol and stylben, and inorganic semi-conductors, such as Se, Se-Te, Se-As, CdS, ZnO, a-Si, a-SiC, a-SiO and a-SiN.

In the case where the carrier transport layer is formed of a-Si or a-SiC, the carrier transport layer can be formed of the basically same material as the carrier-generating layer, so that it is desirably from the viewpoint of the matter that they can be continuously formed by means of the same one film-forming apparatus. In this case, the photoconductivity is not required for the carrier transport layer but it is required that the dark conductance is set at $10^{-11}$ $(\Omega\cdot cm)^{-1}$ or less to increase the excited carrier mobility and set the charge acceptance at a high value.

That is to say, in the case where the a-Si carrier transport layer is formed, the elements of the group III*a* is contained in the quantity within the desired range to give the intrinsic type, whereby setting the dark conductance at $10^{-11}$ $(\Omega\cdot cm)^{-1}$ or less. In addition, if it is insufficient even though the dark conductance is limited in the above described manner, the carrier barrier layer is formed to heighten the characteristics.

It is desired that a thickness of the carrier transport layer (5) is set within a range of 1 to 100 μm, preferably 5 to 50 μm. There is a tendency that if it is less than 1 μm or less, the carrier transport layer (5) is inferior in charge acceptance, whereby the residual image becomes marked, while if it exceeds 100 μm, the dissolution of images is deteriorated and the residual potential is increased.

According to the present invention, the divided function type sensitive member, in which the carrier transport layer (5) and the carrier-generating layer (3) are used as the indispensable layers and both the layer (5) and the layer (3) are piled up in an order shown in FIGS. 1, 2, is usual, but this order of piling up may be changed.

That is to say, a thin film of the carrier-generating layer (3) can be formed on the substrate (1) and then the organic semiconductors can be applied to the carrier-generating layer (3) to form the carrier transport layer (5).

In addition, said carrier barrier layer (2) is formed for smoothly transferring the carriers toward the substrate side from the carrier transport layer (5) and preventing the carriers from being injected into the carrier transport layer (5) from the substrate and formed of organic materials, such as polyimide resins, and inorganic materials, such as $SiO_2$, SiO, $Al_2O_3$, SiC, $Si_3N_4$, amorphous carbon, a-Si and a-SiC.

In addition, in the case where semi-conductor materials are used in the formation of the carrier barrier layer (2), if a polarity of the sensitive member is selected at a positive polarity or a negative polarity, it is desired to control the conduction type of the sensitive member at P type or N type, whereby the barrier effect is still more improved. For example, the P type semi-conductor materials include a-Si or a-SiC containing the elements of the group III*a*, such as B, or the elements of the group V*a*, such as P, in a quantity within a range of 50 to 10,000 ppm.

It is not always necessary to form the carrier barrier layer (2). According to the present inventors' repeated experiments, if the dark conductance of the carrier transport layer (5) is $10^{-13}$ $(\Omega\cdot cm)^{-1}$ or less, the sensitive member according to the present invention can be sufficiently practically used even though the carrier barrier layer (2) is not formed.

In addition, every material having a high insulating property, high corrosion resistance and high hardness characteristics by itself can be used for forming the surface protective layer (4). For example, the inorganic materials or organic materials similar to those used for forming said carrier barrier layer (2) can be used, whereby the durability and the circumstance resistance of the sensitive member can be heightened.

Thus, the electrophotographic sensitive member according to the present invention heightens the spectral sensitivity of the carrier-generating layer over a wide range of wavelength, whereby increasing the optical attenuation to be suitable for the high-speed copying.

A method of producing an electrophotographic sensitive member according to the present invention will be below.

The carrier-generating layer (3) can be formed by the thin film-forming methods such as the glow-discharge decomposition method, the ion-plating method, the reactive sputtering method, the vacuum vapor deposition method and the thermal CVD method. In addition, the materials to be used in said methods may be solid, liquid or gaseous.

In addition, it is desired from the viewpoint of the possibility of using the similar thin film-forming methods that the layers other than the carrier-generating layer are formed of a-Si or a-SiC. Furthermore, in the case where the similar film-forming apparatus are used, the advantage occurs in that the layers can be continuously piled up in the common thin film-forming means.

For example, in the case where the sensitive member formed of a-Si or a-SiC is produced by the use of the glow discharge decomposition apparatus, a Si element series of gas, such as $SiH_4$, $Si_2H_6$ and $Si_3H_8$, and a C element series of gas, such as $CH_4$, $C_2H_2$, $C_2H_4$, $C_2H_6$ and $C_3H_8$, may be used as the gaseous raw materials, and it is sufficient to use a He gas, a $H_2$ gas and the like as the carrier gas.

With this glow discharge decomposition method, in the case where the a-SiC layer is formed by the use of a mixture gas comprising the above described Si element series of gas and acetylene ($C_2H_2$), this method is desirable from the viewpoint of the possibility of achieving a remarkably increased high-speed film formation. According to the present inventors' repeated experiments, in the case where the $SiH_4$ gas and the $C_2H_2$ gas were used, the film formation speed of 5 to 20 μm/hour was achieved. By the way, in the case where the $SiH_4$ gas and the $CH_4$ gas are used, the film formation speed is about 0.3 to 1 μm/hour.

Figure 17:
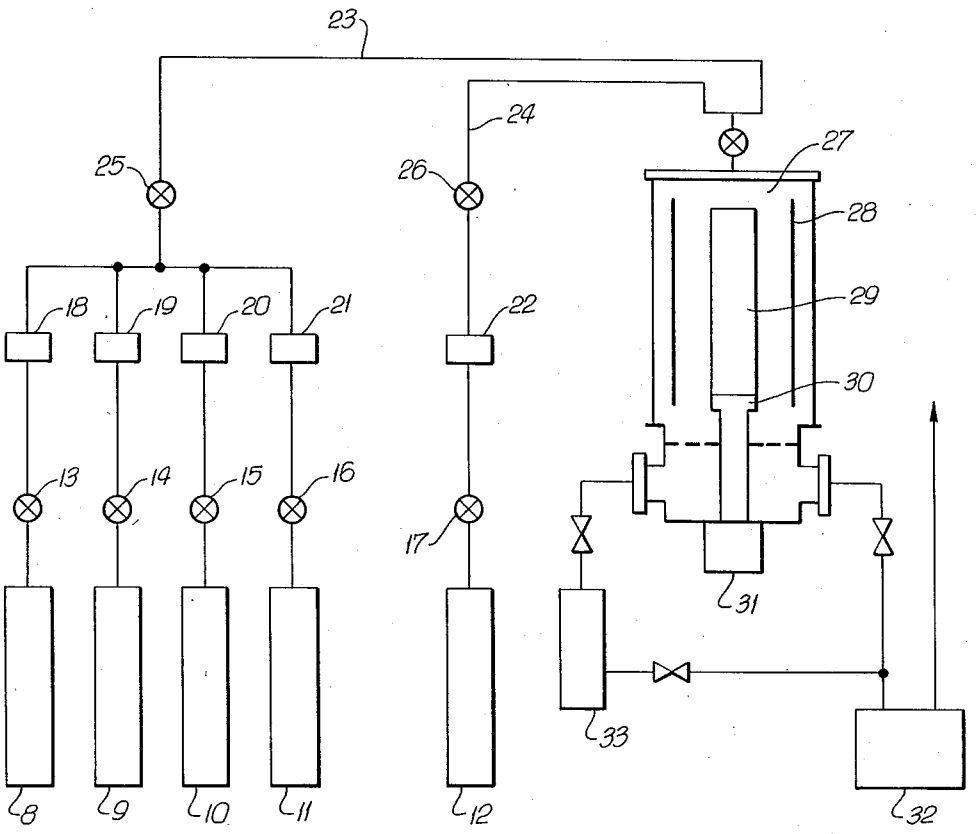
FIG. 17 is an outline showing a capacitively coupled type glow-discharge decomposition apparatus.

Next, the method of producing the a-Si layer or the a-SiC layer by the use of the glow discharge decomposition method will be described with reference to FIG. 17 showing the capacitively couple type glow discharge decomposition apparatus.

Referring to FIG. 17, the $SiH_4$ gas, the $C_2H_2$ gas, the $B_2H_6$ gas or the $PH_3$ gas, the $H_2$ gas and the NO gas is enclosed tightly in a first tank (8), a second tank (9), a third tank (10), a fourth tank (11) and a fifth tank (12), respectively. The $H_2$ gas is used also as the carrier gas. These gases are discharged by opening a first control valve (13), a second control valve (14), a third control valve (15), a fourth control valve (16) and a fifth control valve (17) and flow rates of the gases are controlled by mass flow controllers (18), (19), (20), (21), (22). The gases discharged from the first tank (8), the second tank (9), the third tank (10) and the fourth tank (11) are sent to a first main pipe (23) while the NO gas discharged from the fifth tank (12) is sent to a second main pipe (24). In addition, reference numerals (25), (26) designate stop valves. The gases passing through the first main pipe (23) and the second main pipe (24) are sent to a reaction tube (27) but this reaction tube is provided with a capacitively couple type discharge electrode (28) disposed therewithin and the suitable high-frequency electric power to be applied thereto is 50 W to 3 KW and the suitable frequency is 1 to 10 GHz. A cylindrical film-forming substrate (29) formed of aluminum is placed on a sample-holding table (30) within the reaction tube (27), said sample-holding table (30) being adapted to be rotationally driven by means of a motor (31), and the substrate (29) being uniformly heated to temperatures of about 200° to 400° C., preferably about 200° to 350° C., by means of a suitable heating means. In addition, it is required that an inside of the reaction tube (27) is held under a remarkably high vacuum condition (a gas pressure of 0.1 to 2.0 Torr when discharged) during the formation of the a-Si film. To this end, the reaction tube (27) is connected with a rotary pump (32) and a diffusion pump (33).

With the glow discharge decomposition apparatus having the above described construction, in the case where for example an a-SiC film containing a B element or a P element, an O element and a N element is formed on the substrate (29), the first control valve (13), the second control valve (14), the third control valve (15) and the fourth control valve (16) are opened to discharge the $SiH_4$ gas, the $B_2H_6$ gas or the $PH_3$ gas and the $H_2$ gas from the respective valves while the fifth control valve (17) is opened to discharge the NO gas. The flow rates of the gases are controlled by means of the mass flow controllers (18), (19), (20), (21), (22) and the mixture gas comprising $SiH_4$, $C_2H_2$. $B_2H_6$ or $PH_3$ and $H_2$ is poured into the reaction tube (27) through the first main pipe (23) while the NO gas is poured into the reaction tube (27) through the second main pipe (24). And, since the inside of the reaction tube (27) is held under a vacuum condition of 0.1 to 2.0 Torr, the substrate temperature being set at 200° to 400° C., the high-frequency electric power of the capacitively couple type discharge electrode (28) being set at 50 W to 3 KW, and the frequency being set at 1 to 10 GHz, so that the glow discharge is brought about to decompose the gases, whereby the a-SiC film is speedily formed on the substrate.

The preferred embodiments of the present invention will be below described.

EXAMPLE 1

The carrier transport layer (5) and the carrier-generating layer (3) were piled up in turn on the substrate (29) formed of aluminum (same as the substrate (1) shown in the above described FIG. 1 and FIG. 2) under the film-forming conditions shown in Table 1 and Table 2 by the use of the glow discharge decomposition apparatus shown in FIG. 17 to produce a sensitive drum.

In addition, numerical values put in parentheses and marked with * in the Tables show the concentration of the $B_2H_6$ gas or the $PH_3$ gas when diluted with the $H_2$ gas.

TABLE 1

| Layer construction | Gas flow rate (sccm) $SiH_4$ | $C_2H_2$ | $H_2$ | $B_2H_6$ (38 ppm)* | Gas pressure (Torr) | High frequency electric power (W) | Film forming time (min) | Thickness (μm) |
|---|---|---|---|---|---|---|---|---|
| A-SiC layer zone of the carrier-generating layer | 20 | 1 | 680 | 20 | 1.20 | 150 | 30 | 0.6 |
| A-Si layer zone of the carrier-generating layer | 220 | — | 250 | 1.7 | 0.60 | 150 | 25 | 2.0 |
| Carrier transport layer | 300 | 30 | 250 | 50 | 0.60 | 250 | 200 | 25 |

TABLE 2

| Layer construction | Gas flow rate (sccm) $SiH_4$ | $C_2H_2$ | $H_2$ | $PH_3$ (40 ppm)* | Gas pressure (Torr) | High frequency electric power (W) | Film forming time (min) | Thickness (μm) |
|---|---|---|---|---|---|---|---|---|
| A-SiC layer zone of the carrier-generating layer | 20 | 1 | 680 | 20 | 1.20 | 150 | 30 | 0.6 |
| A-Si layer zone of the carrier generating layer | 220 | — | 250 | — | 0.60 | 150 | 25 | 2.0 |
| Carrier transport layer | 300 | 30 | 250 | — | 0.60 | 250 | 200 | 25 |

Figure 18:
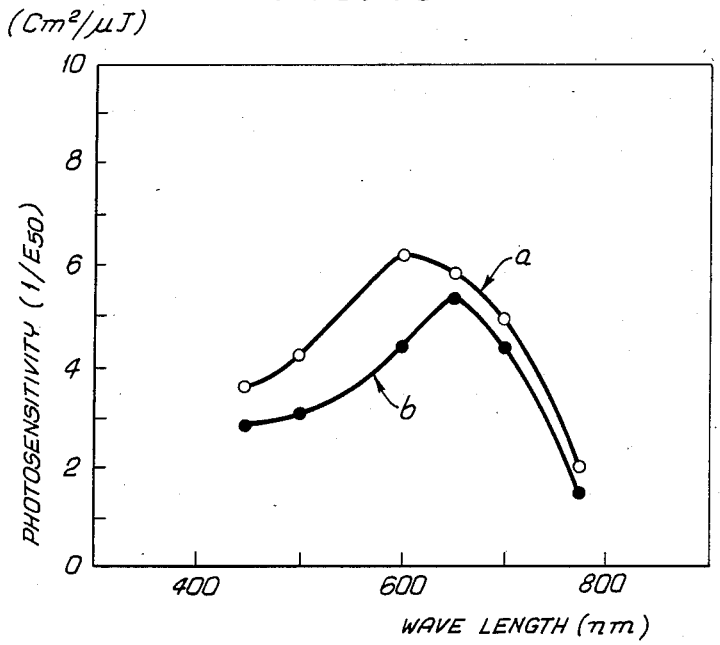
FIGS. 18, 19 are graphs showing spectral sensitivity curves.
Figure 19:
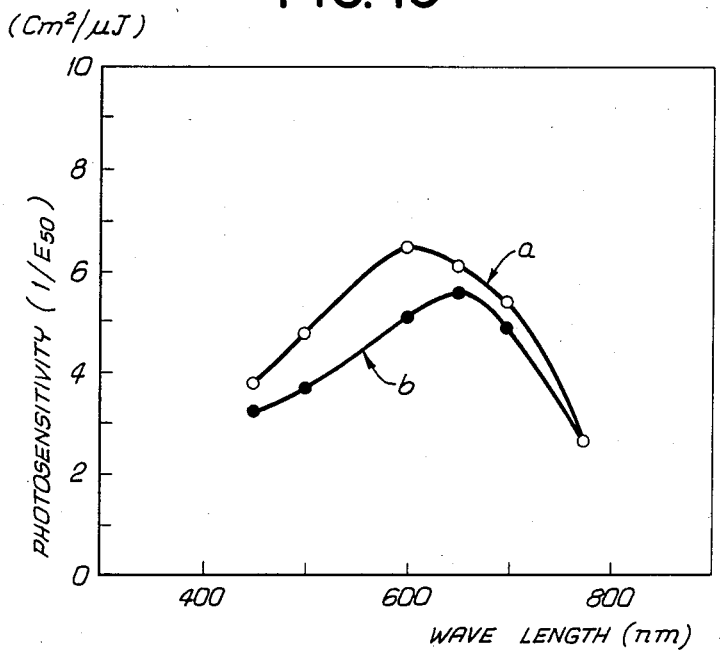

A monochromatic light of 0.3 $\mu W/cm^2$ spectralized by a visible ray spectromer is incident upon the resulting sensitive drum to measure a half-life period of the surface potential and the spectral sensitivity with the results as shown in FIGS. 18, 19.

Referring to FIGS. 18, 19, an axis of abscissa shows a wavelength while an axis of ordinate shows the photosensitivity. And, marks ○ show a plot of the measured results while a shows the characteristic curve.

Also, in FIGS. 18 and 19, the sensitive drum from which a-SiC layer zone is taken out is shown as a Comparative Example. When its spectral sensitivity is measured, a plot shown in measured result designated by ● mark is obtained, and b is its characteristic curve.

As obvious from these results, the sensitive drum according to the present invention exhibits the remarkably increased photosensitivity on the shorter wavelength side.

In addition, the carbon-content in the above described photoconductive a-SiC layer was determined by the Electron Spectroscopy for Chemical Analysis with the result that the value x in $Si_{1-x}C_x$ amounts to 0.12. Furthermore, the B-content and the P-content were determined by the secondary ion mass analyzer with the results that the former amounts to 25 ppm while the latter amounts to 20 ppm.

In the case where an image was obtained by a cycle that the sensitive drum according to the present invention was placed on a high-speed copying machine and then the sensitive member is positively and negatively electrified by means of a coronacharger at +5.6 KV and −5.6 KV followed by subjecting the image to the exposure to bring about the magnetic brushing development, even though the printing speed was increased up to the high-speed copying level of 80 pieces/min, a good quality image having a high image concentration, not bringing about a background smearing showing a high contrast and bringing about no residual image was obtained.

On the contrary, in the case where a sensitive drum according to the Comparative Example was placed on the above described high-speed copying machine to obtain the image in the same manner, if a red color-cutting filter was not used, red letters were not clearly expressed. In addition, if this filter was used, the red letters were expressed while the fogging of a white ground was found.

EXAMPLE 2

According to the present EXAMPLE, the carrier barrier layer (2), the carrier transport layer (5), the carrier-generating layer (3) and the surface protective layer (4) were piled up in turn on the substrate formed of aluminum under the film-forming conditions as shown in Table 3 and Table 4 to produce a sensitive drum as shown in FIG. 2.

In addition, numerical values put in parentheses and marked with * in the Tables show the concentration of the $B_2H_6$ gas or $PH_3$ gas when diluted with the $H_2$ gas.

TABLE 3

| Layer construction | Gas flow rate (sccm) $SiH_4$ | $C_2H_2$ | $H_2$ | $B_2H_6$ (0.2%)* | $B_2H_6$ (38 ppm)* | NO | Gas pressure (Torr) | High frequency electric power (W) | Film forming time (min) | Thickness (μm) |
|---|---|---|---|---|---|---|---|---|---|---|
| Surface protective layer | 60 | 90 | 200 | — | — | — | 0.30 | 120 | 20 | 0.5 |
| A-SiC layer zone of the carrier generating layer | 20 | 1 | 680 | — | 20 | — | 1.20 | 150 | 30 | 0.6 |
| A-Si layer zone of the carrier-generating layer | 220 | — | 250 | — | 1.7 | — | 0.60 | 150 | 25 | 2.0 |
| Carrier transport layer | 300 | 30 | 250 | — | 50 | — | 0.60 | 150 | 200 | 2.5 |
| Carrier barrier layer | 100 | 10 | 300 | 20 | — | 2.5 | 0.45 | 80 | 90 | 2.5 |

TABLE 4

| Layer construction | Gas flow rate (sccm) $SiH_4$ | $C_2H_2$ | $H_2$ | $PH_3$ (0.2%)* | $PH_3$ (40 ppm)* | NO | Gas pressure (Torr) | High frequency electric power (W) | Film forming time (min) | Thickness (μm) |
|---|---|---|---|---|---|---|---|---|---|---|
| Surface protective layer | 60 | 90 | 200 | — | — | — | 0.30 | 120 | 20 | 0.5 |
| A-SiC layer zone of the carrier-generating layer | 20 | 1 | 680 | — | 20 | — | 1.20 | 150 | 30 | 0.6 |
| A-Si layer zone of the carrier-generating layer | 220 | — | 250 | — | — | — | 0.60 | 150 | 25 | 2.0 |
| Carrier transport layer | 300 | 30 | 250 | — | — | — | 0.60 | 150 | 200 | 2.5 |
| Carrier barrier layer | 100 | 10 | 300 | 20 | — | 2.5 | 0.45 | 80 | 90 | 2.5 |

A light emitted from a halogen lamp was incident upon the resulting sensitive drum placed on the high-speed copying machine without using the red color-cutting filter and then the sensitive member was positively or negatively electrified by applying a voltage of +5.6 KV or −5.6 KV to it by means of a corona-charger followed by measuring the surface potential, the photoconductivity and the residual potential with the results shown in the following Table 5.

TABLE 5

| | Voltage applied to the corona-charger: Positively electrified at + 5.6 KV | Negatively electrified at − 5.6 KV |
|---|---|---|
| Surface potential | + 750 V | −700 V |
| Photosensitivity (recorded | 0.60 lux · sec | 0.54 lux · sec |

TABLE 5-continued

| | Voltage applied to the corona-charger | |
|---|---|---|
| | Positively electrified at + 5.6 KV | Negatively electrified at − 5.6 KV |
| exposure quantity) | | |
| Residual potential (the value after 5 seconds from the start of exposure) | 30 V | 25 V |

In addition, this sensitive drum was placed on the high-speed copying machine to be subjected to a test of taking out an image at a speed of 80 pieces/min with the results that the faithful reproducibility was obtained for the black and red portions and further a distinct image having a high concentration and showing no background smearing obtained.

EXAMPLE 3

In the present EXAMPLE the B-content or the P-content and the C-content in the a-SiC layer zone of the sensitive drum obtained in EXAMPLE 2 were variously changed and the resulting sensitive drums (A) to (V) were evaluated in image quality with the results as shown in Table 6 and Table 7.

The evaluations are classified into three kinds of image quality: ◎ mark indicates the case where the image concentration is high, the background smearing being not brought about at all, and the reproducibility of red color being superior; ○ mark indicating the case where the image concentration is high, the background smearing being hardly brought about, and also the producibility of red color showing no difficulty in practically using; and x mark indicating the case where the photosensitivity in the shorter wavelength side is lower, whereby the reproducibility of red color is deteriorated, and the background smearing is brought about so as to show difficulty in practically using.

In addition, the sensitive members marked with * are those out of the scope of the present invention.

TABLE 6

| Kind of sensitive member | B-content (ppm) | C-content (value x) | Image quality |
|---|---|---|---|
| A* | 0.3 | 0.005 | X |
| B* | 0.3 | 0.03 | X |
| C | 0.7 | 0.07 | ○ |
| D | 5 | 0.12 | ◎ |
| E | 10 | 0.2 | ◎ |
| F | 30 | 0.12 | ◎ |
| G | 30 | 0.2 | ◎ |
| H | 70 | 0.12 | ○ |
| I | 70 | 0.2 | ○ |
| J* | 120 | 0.4 | X |
| K* | 120 | 0.6 | X |

TABLE 7

| Kind of sensitive member | P-content (ppm) | C-content (value x) | Image quality |
|---|---|---|---|
| L | 0 | 0.03 | ○ |
| M | 0 | 0.07 | ○ |
| N | 0.5 | 0.07 | ○ |
| O | 3 | 0.12 | ◎ |
| P | 8 | 0.2 | ◎ |

TABLE 7-continued

| Kind of sensitive member | P-content (ppm) | C-content (value x) | Image quality |
|---|---|---|---|
| Q | 25 | 0.12 | ◎ |
| R | 25 | 0.2 | ◎ |
| S | 60 | 0.12 | ○ |
| T | 60 | 0.2 | ○ |
| U* | 120 | 0.4 | X |
| V* | 120 | 0.6 | X |

As obvious from Tables 6, 7, the sensitive members (C) to (I) and (L) to (T) according to the present invention exhibited superior characteristics from all viewpoints of image concentration, background smearing and reproducibility of red color.

However, the sensitive members (A), (B), (J), (K), (U), (V) were out of the scope of the present invention in B-content or P-content and thus they were inferior from all viewpoints of photosensitivity on the shorter wavelength side, background smearing and producibility of red color.

As above described, the electrophotographic sensitive member according to the present invention can be used as the divided function type sensitive member and the spectral sensitivity of the carrier-generating layer thereof can be heightened over a wide wavelength range, thereby the optical attenuation can be increased. As a result, the electrophotographic sensitive member according to the present invention becomes suitable for the high-speed copying.

We claim:

1. An electrophotographic sensitive member comprising at least a carrier transport layer and a carrier-generating layer formed on an electrically conductive substrate, said carrier-generating layer being formed of a layer zone formed of substantially all amorphous silicon and a layer zone formed of amorphous silicon carbide containing elements of the group III*a* or V*a* in the Periodic Table in a quantity of 0.5 to 100 ppm, said layer zones formed in turn, each layer zone further containing hydrogen or a halogen element and having a thickness of between 0.05 and 5 microns.

2. An electrophotographic sensitive member formed on an electrically conductive supporting substrate comprising:

a carrier generating layer having a second layer zone formed on a first layer zone, said first layer zone being substantially formed of amorphous silicon, said second layer zone being substantially formed of amorphous silicon carbide containing elements from group III*a* or V*a* in a quantity of between 0.5 and 100 parts per million, each of said first layer zone and said second layer zone further containing hydrogen or a halogen element and having a thickness of between 0.05 and 5 microns; and a carrier transport layer having a thickness of between 1 and 100 microns.

3. The electrophotographic sensitive member of claim 2 wherein said second layer zone has a thickness of between 0.1 and 3 microns.

4. The electrophotographic sensitive member of claim 2 wherein said second layer zone contains elements from Group III*a* or V*a* in a quantity of between 1 and 50 parts per million 5. The electrophotographic sensitive member of claim 2 wherein said first layer zone has a thickness of between 0.1 and 3 microns.

6. The electrophotographic sensitive member of claim 2 wherein said first layer zone contains carbon in a quantity of 1,000 parts per million or less.

7. The electrophotographic sensitive member of claim 2 wherein the first layer zone contains carbon in an amount of 500 parts per million or less.

8. The electrophotographic sensitive member of claim 2 wherein said first layer zone contains elements from Group III*a* or V*a* in a quantity of between 0.01 and 10 parts per million.

9. The electrophotographic sensitive member of claim 2 wherein said first layer zone contains elements of Group III*a* or V*a* in a quantity of between 0.1 and 5 parts per million 10. The electrophotographic sensitive member of claim 2 wherein said carrier transport layer is formed of a material selected from the group consisting of PVK, pyrazoline, oxozol, hydrazone, N-phenylcarbazol stylben, Se, Se-Te, Se-As, CdS, ZnO, a-Si, a-SiC, a-SiO, and a- SiN.

11. The electrophotographic sensitive member of claim 2 wherein said carrier transport layer has a thickness of between 5 and 50 microns.

12. The electrophotographic sensitive member of claim 2 further comprising a carrier barrier layer containing a material selected from the group consisting of $SiO_2$, SiO, $Al_2O_3$, SiC, $Si_3N_4$, amorphous carbon, a-Si, and a-SiC.

13. The electrophotographic sensitive member of claim 2 wherein said second layer zone contains Boron.

14. The electrophotographic sensitive member of claim 2 wherein said second layer zone contains Phosphorous.

* * * * *